United States Patent [19]

Takiguchi et al.

[11] Patent Number: 4,720,452

[45] Date of Patent: Jan. 19, 1988

[54] LIGHT-SENSITIVE SILVER HALIDE PHOTOGRAPHIC MATERIAL

[75] Inventors: Hideki Takiguchi; Toshifumi Iijima; Toshihiko Yagi; Yoshihiro Haga, all of Hino, Japan

[73] Assignee: Konishiroku Photo Industry Co., Ltd., Tokyo, Japan

[21] Appl. No.: 894,702

[22] Filed: Aug. 7, 1986

Related U.S. Application Data

[63] Continuation of Ser. No. 679,597, Dec. 7, 1984, abandoned, and a continuation-in-part of Ser. No. 519,552, Aug. 2, 1983, abandoned.

[30] Foreign Application Priority Data

Aug. 10, 1982 [JP] Japan ..... 57-139561

[51] Int. Cl.[4] ..... G03C 1/02

[52] U.S. Cl. ..... 430/567; 430/568; 430/569

[58] Field of Search ..... 430/567, 568, 569

[56] References Cited

U.S. PATENT DOCUMENTS

| | | | |
|---|---|---|---|
| 3,885,970 | 5/1975 | Miyahara | 430/567 |
| 4,045,228 | 8/1977 | Vanassche et al. | 430/567 |
| 4,184,877 | 1/1980 | Maternaghan | 430/569 |
| 4,400,463 | 8/1983 | Maskasky | 430/567 |
| 4,414,306 | 11/1983 | Wey et al. | 430/567 |
| 4,469,784 | 9/1984 | Heki et al. | 430/567 |
| 4,496,652 | 1/1985 | Haugh et al. | 430/567 |

FOREIGN PATENT DOCUMENTS 126234 9/1980 Japan .

OTHER PUBLICATIONS

Berry et al, "Crystal Imperfections and Electron-Trapping Sites in AgBr," Photo. Sci. & Eng., vol. 8, No. 6, Dec. 1964, pp. 346–352.

Sugimoto, "Reversed Ostwald Ripening," J. Soc. Photogr. Sci. Technol. Japan, vol. 46, No. 4, 1983, pp. 306–312.

Birch et al, "Sensitivity and Chemical Sensitization of Silver Bromide Grain Faces of Different Crystallographic Index," Journal of Photo Sci., vol. 23, 1975, pp. 249–256.

Bogg et al, "Studies of Ostwald Ripening of a Model Silver Bromide Emulsion System," Journal of Photo. Sci., vol. 24, 1976, pp. 81–95.

Rogers, "Transition in Crystal Habit in Silver Bromide Emulsions," Journal of Photo Sci., vol. 27, 1979, pp. 47–53.

Harding, "The Application of Calculations of Complex Solubility to the Interpretation of Crystal Growth Phenomena in Silver Halide Emulsions," Journal of Photo Sci., vol. 27, 1979, pp. 1–12.

Sugimoto, "Stable Crystal Habits of General Tetradecahedral Microcrystals and Monodisperse AgBr Particles," Journal of Colloid & Interface Sci., vol. 91, No. 1, Jan. 1983, pp 51–68 and vol. 93, No. 2, Jun. 1983, pp. 461–473.

*Primary Examiner*—Won H. Louie

*Attorney, Agent, or Firm*—Frishauf, Holtz, Goodman & Woodward

[57] ABSTRACT

A light-sensitive silver halide photographic material having silver halide emulsion layers on a support, wherein at least one layer of said silver halide emulsion layers contains surface latent image type mono-dispersed silver halide grains, and 50% or more of the silver halide grains contained in said at least one silver halide emulsion layer are regular surface latent image type mono-dispersed silver halide grains of tetradecahedral crystals whose external surfaces have crystal faces with Miller indices (100) and (111), the area ratio of said (100) face and said (111) face satisfying the relation represented by the correlation formula (I) shown below:

correlation formula (I):

$$\frac{100}{13} \leqq K \leqq \frac{100}{0.2} \qquad \text{(I)}$$

wherein K is the ratio between the intensities of respective diffraction lines attributable to the (200) face and the (222) face measured in X-ray diffraction analysis as set forth in the following formula $$K = \frac{\text{Diffraction line intensity due to (200) face}}{\text{Diffraction line intensity due to (222) face}}.$$

10 Claims, No Drawings

LIGHT-SENSITIVE SILVER HALIDE PHOTOGRAPHIC MATERIAL

This application is a continuation of application Ser. No. 679,597, filed Dec. 7, 1984, which is a continuation-in-part of Ser. No. 519,552 filed Aug. 2, 1983, now abandoned.

This invention relates to improvement of a light-sensitive silver halide photographic material, more particularly to a light-sensitive silver halide photographic material, which is excellent in sensitivity and also excellent in stability with lapse of time as an emulsion coating solution and a light-sensitive material.

In recent years, as an aspect of the progress in photographing techniques, it is strongly desired that cameras should be minituarized and light weight, and yet also capalbe of simple photographing with no failure. Light-sensitive silver halide photographic materials are required to be improved to provide higher performance. For example, it is strongly desired to develop a light-sensitive silver halide photographic material having higher sensitivity as well as excellent sharpness and desired graininess characteristics, and moreover having a broad exposure latitude.

Concerning improvement of photographic performance of a light-sensitive silver halide photographic material, for example, it has been proposed to use a mono-dispersed emulsion in which the silver halide grains have substantially uniform shapes and also narrow grain size distribution, resulting in improved quantum efficiency as well as excellent sensitizing efficiency.

Also, use of such a mono-dispersed emulsion has received attention as being potentially applicable for development of a light-sensitive silver halide photographic material with a low silver content, which is particularly desired in recent years to achieve high sensitization without increase of fog.

Thus, a mono-dispersed emulsion is an emulsion excellent in sensitizing efficiency which can impart nuclei for chemical sensitization uniformly to individual silver halide grains during chemical ripening, but it has the drawbacks that the tone (gradation) of the image becomes hard and that the exposure latitude becomes narrow. Further, depending on the shape of the grains, the above nuclei for chemical sensitization are liable to be formed in overly great number, whereby sensitizing efficiency may be lowered. Alternatively, in some cases, due to poor adsorbability of the sensitizing dye, desorption of the dye may occur during the manufacturing step of the light-sensitive silver halide photographic material, thus indicating strongly a tendency to cause sensitivity reduction. Also, in a mono-dispersed emulsion with grains having another shape, storage stability is inferior and fog is generated not only in the chemical ripening step, but also is liable to occur in the manufacturing steps of the light-sensitive silver halide photographic material after the chemical ripening step or during prolonged storage of the light-sensitive silver halide photographic material.

As another technique to improve image characteristics such as gradation, graininess or sharpness for the purpose of improving the image quality of a high sensitivity light-sensitive silver halide photographic material, it is well known in the art to change the silver halide composition, especially the silver iodide content in silver iodobromide, to improve the image quality through utilization of the development inhibiting effect by the iodine ions released during development. However, enhancement of silver iodide content, while it is preferable as a means for improving the image quality, acts on the other hand inhibitively against the sulfur sensitizing action during chemical ripening or the developing action, and therefore it cannot necessarily be said to be a preferable means for improvement of sensitization.

The above sensitivity reduction caused by the inhibiting action occurring during chemical ripening or developing may be restored considerably by, for example, adding a sulfur sensitizer or a gold sensitizer in an increased amount. However, at the same time, such an emulsion coating solution will lower shelf stability of a light-sensitive material with the result that fog is liable to be generated.

Therefore, an object of this invention is to provide a light-sensitive silver halide photographic material which is low in fog and high in sensitivity, and it is also another object of this invention to provide a light-sensitive silver halide photographic material which is excellent in stability with lapse of time as an emulsion coating solution and also as a light-sensitive material.

The present inventors have made various investigations on the above task and consequently found that the above objects can be accomplished by a light-sensitive silver halide photographic material having silver halide emulsion layers on a support, wherein at least one layer of said silver halide emulsion layers contains surface latent image type mono-dispersed silver halide grains, and the external surfaces of 50% or more of the silver halide grains contained in said at least one silver halide emulsion layer are regular surface latent image type mono-dispersed silver halide grains of tetradecahedral crystals whose external surfaces have crystal faces with Miller indices (100) and (111), the area ratio of said (100) face and said (111) face satisfying the relation represented by the correlation formula (I) shown below:

Correlation formula (I):

$$\frac{100}{13} \leqq K \leqq \frac{100}{0.2} \qquad \text{(I)}$$

wherein K is the ratio between intensities of respective diffraction lines attributable to (200) face and (222) face measured in X-ray diffraction analysis, namely:

$$K = \frac{\text{Diffraction line intensity due to (200) face}}{\text{Diffraction line intensity due to (222) face}}$$

Surface latent image type emulsion is an emulsion in which chemical sensitizing nuclei are provided at the surface (or a region adjacent to the surface) of silver halide grains so that the photo-electrons or the photo-decomposition silver produced by exposure to light are gathered on the sensitizing nuclei at the surface, thereby forming latent images at the surface.

The reason why the present invention is particularly effective in the surface latent image type emulsion is as follows:

The sensitizing dyes generally used decrease the specific sensitivity of silver halide. In particular, dyes liable to be desorbed from the surface of silver halide grains are finally adsorbed on the light-sensitive nuclei of silver sulfide or the like present at the surface of the silver halide grains while repeating adsorption—desorbtion reactions, to give desensitizing action. Accordingly, the present invention, in which the latent images (development nuclei) are formed at the surface of silver halide grains, is particularly effective in the surface latent image type emulsion.

In the following, this invention will be described in detail.

The mono-dispersed silver halide grains utilized this invention refer to those which exhibit uniform shapes of individual silver halide grains when the emulsion is observed with an electron microscope photograph, have regular grain sizes, that is substantially uniformly and evenly arranged grain sizes. The grain size distribution is defined by the following formula. Namely, when the standard deviation S of the grain size distribution is divided by the mean grain size $\bar{r}$, its value is 0.20 or less.

$$S = \sqrt{\frac{\Sigma(\bar{r} - r_i)^2 n_i}{\Sigma n_i}}$$

$$\frac{S}{\bar{r}} \leqq 0.20$$

The mean grain size herein mentioned refers to the mean value of diameters in the case of spherical silver halide grains or a mean value of diameters of circular images calculated to be of the same area from the projected images in the case of cubic or other shapes than spheres, and $\bar{r}$ may be defined by the following formula, when individual grain sizes are represented by ri and their numbers by ni:

$$\bar{r} = \frac{\Sigma ni\, ri}{\Sigma ni}$$

The above grain sizes can be measured according to various methods generally employed in the relevant field of art for the above purpose. Representative methods are disclosed in Rubland, "Grain Size Analytical Method", A.S.T.M. Symposium on light microscopy, 1955, pp. 94–122 or "Theory of Photographic Process" by Mieth & James, 3rd edition, Chap. 2 published by Macmillan Co. (1966). This grain size can be measured by use of the projected area of grains or approximate diameter values. When the grains are substantially of uniform, the grain size distribution can be expressed with considerable accuracy as a diameter or projected area.

The relation of the grain size distribution can be determined according to the method described in the essay by Triberi and Smith in "Empirical relation between the sensitometry distribution and grain size distribution in photographic emulsions", The Photographic Journal vol. LXXIX (1949), pp. 330–338.

The silver halide grains to be used in the light-sensitive silver halide photographic material according to this invention may preferably contain 75% or more, particularly preferably all, based on the total grains in the same silver halide emulsion layer of the mono-dispersed silver halide grains according to this invention. Also, there may be contained silver halide grains other than the mono-dispersed silver halide grains for the purpose of controlling the tone gradation.

Further, the silver halide grains according to this invention are silver halide grains, among which 50% or more of the total grains contained in the same silver halide emulsion layer have crystal faces satisfying the correlation as shown below:

$$\frac{100}{13} \leqq K \leqq \frac{100}{0.2} \qquad \text{(I)}$$

As to the definition of the face of the silver halide grains in this invention, it may be defined by use of the diffraction chart obtained by the X-ray diffraction analysis according to the powder method of an emulsion containing an emulsion coated with orientation on a substrate, as described in, for example, "Bulletin of the Society of Scientific Photography of Japan", vol. 13, page 5.

The method described in said Bulletin is based on the fact that when the emulsion contains a large number of course grains oriented in parallel with the surface of the support, the diffraction from the emulsion layer would not show a powder profile but would provide data from the diffraction intensities of the desired faces and therefore could show the shape of the microcrystals. In order to make any one surface of each microcrystal closely adhere to the surface of the slide glass, removal of the gelatin from the emulsion is necessary. After addition of trypsin to the emulsion for digestion of the gelatin, the mixture is warmed at 40° C. for 3 hr., and microcrystals are separated with a centrifugal machine, washed with warm water, dispersed in water up to suitable concentration, and arranged into a single layer on the slide glass. Uniformity and suitable density are desired, but coagulation and agglomeration must be avoided for preparation of the best specimen. The flat specimen described above is held at the axis of rotation of the counter arm of the diffractometer to be perpendicular to the equatorial section, and is rotated at half the speed of the counter arm. By this arrangement, which is known as the Bragg-Brentano system, approximate focusing is attained. The counter mounted on an arm can be rotated to record the intensity of diffracted X-rays over a chosen angular range.

Namely, Cu-Ka ray is used as the X-ray in the X-ray diffraction analysis, intensities of the diffraction lines attributable to (200) face corresponding to (100) face of silver halide grains and (222) face corresponding to (111) face [observed at diffraction angles ($2\theta$) of about 30.9° and 55.0°, respectively], and the aforesaid area ratio between (100) face and (111) face is determined from the ratio between the measured intensities. For example, when the complete cubic crystal and the complete octahedral crystal are expressed in terms of intensity ratio between the above two kinds of diffraction lines, namely:

$$K = \frac{\text{Diffraction line intensity due to (200) face}}{\text{Diffraction line intensity due to (222) face}},$$

the former cubic crystal may be represented by K=100/0, while the latter octahedral crystal by K=0/100.

Most grains of silver halide emulsions in past practice generally had twinned crystal structures. Twinned crystal is a crystal comprised of two crystal areas having mutually symmetrical crystal lattices when certain face in a crystal is assumed to be a specular plane (or mirror face). The specular plane is called a twin plane. The twin plane does not always assume single plane for one crystal. Sometimes it assumes double, triple and more planes. For instance, plate-like grains are crystals in which mutually parallel twin planes are double layered or triple layered, and potato-like grains are triple or quadruple twinned crystals having mutually non-parallel twin planes. On the other hand, the regular crystal employed in the present invention is a crystal not having such twinned crystal structure as mentioned above, and is an isotropic crystal such as a cube, an octahedron and a tetradecahedron. (As a related publication, see "The Theory of the Photographic Process, Fourth Edition", edited by T. H. James, Macmillan Publishing Co., Inc., pp. 21–23 (1977) or a Japanese publication "Fundamentals of Photographic Engineering", Edition for Silver Salt Photography, edited by Japanese Photographic Society and published by Corona-Sha Co., pp. 161–167 (1979).)

Accordingly, preferable silver halide grains in this invention according to the former method are mono-dispersed silver halide emulsions falling within the range of $100/13 \leqq K \leqq 100/0.2$. Also, in the light-sensitive silver halide photographic material of this invention, it is suitable for accomplishing the objects of this invention to use silver halide grains contained in the silver halide emulsion layer, comprising silver iodide at a level of 3 to 12 mole %, preferably 5 to 10 mole %. The silver halide composition other than the above silver iodide is primarily silver bromide, but a minute amount of silver chloride may also be present, so far as the effect of this invention is not damaged.

Further, the silver halide grains according to this invention should preferably be silver halide grains of the so called core-shell type. The core-shell type silver halide grains according to this invention consist of cores comprising a silver halide containing silver iodide and shells comprising primarily silver bromide covering over said cores, said shells having a thickness of 0.001 to 0.1μ.

As a preferred embodiment of the silver halide grains of this invention, the silver halide composition of said cores is a silver halide containing 3 to 12 mole % of silver iodide and the aforesaid shells comprise substantially silver bromide containing 0 to 6 mole % of silver iodide (the content of silver iodide is smaller in the shells than in the cores, the content of silver iodide in the whole particles being preferably 3 to 12 mole %).

According to another preferred embodiment of the silver halide grains of this invention, the above cores are mono-dispersed silver halide grains, and the the above shells have a thickness of 0.002 to 0.08μ.

The silver halide emulsion having silver halide grains with shells of specific thickness can be prepared by using silver halide grains contained in mono-dispersed emulsion and forming shells thereon.

The silver halide grains of the invention satisfying the correlation formula (I) can be obtained according to a conventional double jet method by controlling pAg and pH. The method as disclosed in Japanese Unexamined Patent Publication No. 48521/1979 can be applied. For example, it can be produced according to the method in which an aqueous potassium iodobromide-gelatin solution and an aqueous ammoniacal silver nitrate solution are added into an aqueous gelatin solution containing silver halide seed grains, while varying the addition rate as a function of time. During this operation, by suitable selection of the time function of the addition rate, pH, pAg and temperature, it is possible to obtain a highly mono-dispersed silver halide emulsion.

In more detail Japanese Unexamined Publication No. 48521/1979 discloses a method for preparation of a monodispersed emulsion comprising silver bromide or silver iodobromide having a prescribed grain size, having a prescribed crystal habit and containing a prescribed amount of iodine. Namely, there is disclosed a method of preparing desired silver halide crystals by adding continuously an aqueous solution of silver salt and an aqueous solution of halogen salt to a suspension containing seed crystals of silver halide, in which method the addition rate at an optional stage during crystal growth is varied in accordance with an addition rate equation represented as a function of percentage of iodine content in silver iodobromide, pAg and ammonia concentration in the reaction solution, grain size of the growing crystals and mean distance between grains in the growing crystals, thereby obtaining an emulsion containing the desired silver halide grains. More specifically, it is a method of preparing silver bromide and silver iodobromide crystals for use in a light-sensitive photographic material, comprising allowing seed crystals to grow by simultaneously adding and reacting an aqueous solution of silver salt and an aqueous solution of halogen salt in the presence of a protective colloid, and characterized by adding these two kinds of aqueous solutions at the addition rate ranging from an addition rate Q (mol/min) represented by the following equation to an addition rate of not less than 50% of said addition rate:

$$Q = \left\{ \left( \frac{\bar{x}^{14} + y}{\bar{x}^{14}} \right)^3 - 1 \right\} \times (m_0 + m)$$

wherein $\bar{x}$ is the grain size (μm) of growing crystals, $m_0$ is the amount (mol) of seed crystals initially added, m is the total amount (mol) of added aqueous solution of silver salt, and y is a value obtained by the following equation:

$$\text{"}y = 10\{fa(I) + fb(pAg) + fc(CNH_3) + fd(r,x)\}\text{"}.$$

wherein $$fa(I) = a_0 + a_1 I,$$

$$fb(pAg) = b_0 + b_1(pAg) + b_2(pAg)^2 + b_3(pAg)^3 + b_4(pAg)^4 + b_5(pAG)^5,$$

$$fc(CNH_3) = \frac{C_1}{CNH_3 + C_0} + C_2$$

$$fd(r,\bar{x}) = d_0 + d_1(r - \bar{x} + 0.5) + d_2(r - \bar{x} + 0.5)^2 + d_3 \log$$

and wherein I is the iodine content (mole percent) in silver iodobromide, pAg is the cologarithm of ion concentration in the reaction solution, $CNH_3$ is ammonia concentration (mol/l) in the reaction solution, r is means distance (μm) between grains of growing crystals, and $a_0$, $a_1$, $b_0$, $b_1$, $b_2$, $b_3$, $b_4$, $b_5$, $c_0$, $c_1$, $c_2$, $d_0$, $d_1$, $d_2$ and $d_3$ each are value shown in the following Table:

| | |
|---|---|
| $a_0$ | +0.07938 |
| $a_1$ | −0.01323 |
| $b_0$ | +4178.9825 |
| $b_1$ | −2831.27994 |
| $b_2$ | +762.55901 |
| $b_3$ | −102.086248 |
| $b_4$ | +6.7915594 |

-continued

| | |
|---|---|
| $b_5$ | −0.1795947 |
| $c_0$ | +0.15 |
| $c_1$ | −0.2146 |
| $c_2$ | +1.4307 |
| $d_0$ | +0.6342 |
| $d_1$ | −0.4590 |
| $d_2$ | +0.04765 |
| $d_3$ | −0.5669. |

In the above method, it is preferred to control the reaction mixture to have pAg ranging from 7 to 11, pH ranging from 2 to 7 and temperature ranging from 35° to 90° C.

Japanese Patent Publication No. 48521/79 states at page 165, lines 7–18, right upper column thereof:

"By adding solutions at the addition rate determined as above, silver iodobromide grains and silver bromide crystals having optional halogen composition (or iodine content), optional average grain size and optional crystal habits. Namely, the crystal habits are known to be controlled by pAg (see, for example, The Journal of Photographic Science, Vol. 12, pp 242–251), and, for example, when no ammonia is present, this invention can give an optimum addition rate for the crystal growth, ranging between the stable region of cubic crystals (pAg is about 6) and the stable region of octahedral crystals (pAg is about 9)."

Referring to the thickness of the shells which cover the cores, it must be a thickness which does not shield (suppress) the preferable properties of the cores, and contrariwise a thickness sufficient to shield (suppress) the unfavorable properties of the cores. Namely, the thickness is limited to a narrow range delimited by such upper and lower limits. Such shells can be formed by depositing on mono-dispersed cores a soluble halogen compound solution and a soluble silver salt solution according to the double jet method.

The light-sensitive silver halide photographic material, incorporating the mono-dispersed emulsion having silver halide grains with crystal faces as defined by said formula (1) as described in detail above cures such defects as lowering in sensitizing efficiency, desorption of dye, increase of fog, deterioration of storability with lapse of time, etc. as observed in the case of conventional monodispersed emulsions containing e.g. octahedral crystals, tetradecahedral crystals or cubic crystals, whereby sensitizing efficiency can be enhanced so far as possible without generation of fog, and exposure latitude can also be improved.

The above effects of this invention can be accomplished by the mono-dispersed silver halide grains having the crystal faces as defined in this invention. The effect can be exhibited more markedly by preparing the emulsion using silver halide grains having a silver iodide content as described above and providing that the grains have a core-shell type structure.

The aforesaid silver halide grains according to this invention can also be enhanced markedly in chemical sensitizing effect by performing chemical ripening in the presence of a solvent for silver halide.

As the solvent for silver halide to be used in this invention, there may be included (a) organic thioethers, as disclosed in U.S. Pat. No. 3,271,157; 3,531,289; and 3,574,628; Japanese Unexamined Patent Publications Nos. 1019/1979 and 158917/1979, (b) thiourea derivatives as disclosed in Japanese Unexamined Patent Publications Nos. 82408/1978, 77737/1980 and 2982/1980, (c) a solvent for silver halide having a thiocarbonyl group sandwiched between an oxygen or sulfur atom and a nitrogen atom as disclosed in Japanese Unexamined Patent Publication No. 144319/1978, (d) imidazoles as disclosed in Japanese Unexamined Patent Publication No. 100717/1979, (e) sulfites, (f) thiocyanates, etc.

Typical compounds of these solvents for silver halide are shown below.

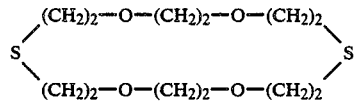

(a)

$HO-(CH_2)_2S-(CH_2)_2-S-(CH_2)_2-OH$ $CH_2-NHCOCH_2CH_2COOH$
$|$
$CH_2-S-CH_2CH_2SC_2H_5$

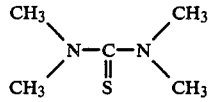

(b)

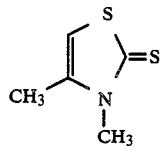

(c)

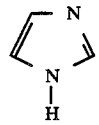

(d)

$K_2SO_3$ (e)
$NH_4SCN$ (f)
KSCN

Particularly preferable solvents are thiocyanates and sulfites.

The amount of the solvent used in this invention may vary depending on the kind of the solvent employed and other factors, but in the case of, for example, a thiocyanate, a preferable amount may range from 5 mg to 1 g per mole of silver halide.

The silver halide grains according to this invention can be sensitized using known chemical sensitizing methods. That is, they can be chemically sensitized with active gelatins; noble metal sensitizers such as water soluble gold salts, water soluble platinum salts, water soluble palladium salts, water soluble rhodium salts, water soluble iridium salts, etc.; sulfur sensitizers; selenium sensitizers; reducing sensitizers such as polyamines, stannous chloride, etc.; either alone or in combination.

In this invention, during the above chemical sensitization, it is preferred to utilize a silver halide solvent as mentioned above with a chemical sensitizer.

The emulsion containing the silver halide grains according to this invention can be optically sensitized to a desired wavelength region. The optical sensitizing method of the silver halide emulsion according to this invention is not particularly limited, and it can be optically sensitized by using cyanine dyes such as zero-methyne dye, mono-methyne dye, di-methyne dye or tri-methyne dye or merocyanine dyes alone or in combination (e.g. strong color sensitization). These techniques are also described in U.S. Pat. Nos. 2,688,545; 2,912,329; 3,397,060; 3,615,635; 3,628,964; U.K. Pat. Nos. 1,195,302; 1,242,588; 1,293,862; German OLS Nos. 2,030,325; 2,121,780; Japanese Patent Publication Nos. 4936/1968 and 14030/1969. Its choice may be determined as desired depending on the purpose and use of the light-sensitive silver halide photographic material such as the wavelength region to be sensitized, sensitivity, etc.

The mono-dispersed silver halide emulsion according to this invention can be provided for use as such with the grain size distribution obtained, or two or more kinds of mono-dispersed silver halide emulsions with different mean grain sizes may be blended at any stage after formation of grains to be formulated to a desired tone gradation before use. However, there may also be included an emulsion containing other silver halide grains than those of this invention within the range, which does not impair the effect of this invention.

The silver halide emulsion according to this invention can also contain various additives conventionally used depending on the purpose. As these additives, there may be included stabilizers or fog preventives such as azaindenes, triazoles, tetrazoles, imidazolium salts, tetrazolium salts, polyhydroxy compounds, etc.; film hardeners such as of aldehyde type, isooxazole type, vinylsulfone type, acryloyl type, adipodiimide type, maleimide type, methanesulfonic acid ester type, triazine type, etc.; development accelerators such as benzyl alcohol, polyoxyethylene type compounds, etc.; image stabilizers such as of cumaron type, cumaran type, bisphenol type, phosphite ester type, etc.; lubricants such as wax, glycerides of higher fatty acid, higher alcohol esters of higher fatty acid, etc. Also, as surfactants, there may be employed various kinds of anionic type, cationic type, nonionic type or amphoteric type, as coating aids, penetration improving agents for processing liquors, defoaming agents or materials for controlling various physical properties of the light sensitive material. As an antistatic agent, there may be effectively used alkali salts of the reaction product between diacetyl cellulose, styrene-perfluoroalkyllithium maleate copolymer, styrene-manelic anhydride copolymer with p-aminobenzenesulfonic acid. As a matting agent, there may be included polymethylmethacrylate, polystyrene and alkali soluble polymers. Further, colloidal silicon oxide may also be available. As a latex to be added for improvement of film properties, there may be included copolymers of an acrylic acid ester or a vinyl ester with other monomers having other ethylene groups. As a gelatin plasticizer, there may be employed glycerine or a glycolic compound, while as a thickener, styrene-sodium maleate copolymer, alkylvinylether-maleic acid copolymer, etc. may be employed.

As a support for the light-sensitive silver halide photographic material made from the silver halide emulsion according to this invention as prepared above, there may be mentioned, for example, baryta paper, polyethylene coated paper, polypropylene synthetic paper, glass paper, cellulose acetate, cellulose nitrate, polyvinyl acetal, polypropylene, polyester film such as polyethyleneterephthalate, polystyrene, etc., and these supports may be suitably selected depending on the respective intended use of the light-sensitive silver halide phtographic material.

These supports may be applied with a subbing treatment, if desired.

The silver halide emulsion according to this invention may be effectively applied for light-sensitive materials of various uses such as monochromatic uses in general, X-ray, color, infra-red, micro, silver dye bleaching method, reversal, diffusion transfer, and other uses.

For applying the silver halide emulsion according to this invention for a light-sensitive silver halide photographic material for color, there may be employed the method and the materials conventionally used such as incorporation of a combination of cyan, magenta and yellow couplers into an emulsion of this invention controlled to red-sensitive, green sensitive and blue-sensitive. As the yellow coupler, there may be used known closed-chain ketomethylene type couplers. Among them, benzoylacetanilide type and pivaloylacetanilide type compounds are useful.

As the magenta coupler, it is possible to use pyrazolone type compounds, indazolone type compounds, cyanoacetyl compounds, and as the cyan coupler, phenol type compounds and naphthol type compounds can be used.

When the silver halide emulsion containing silver halide grains according to this invention is used for such a light-sensitive silver halide color photographic material as mentioned above, it may be applied in all layers of the light-sensitive emulsion layers in, for example, a multi-layer light-sensitive silver halide color photographic material, but it is preferred to be applied in at least the green-sensitive silver halide emulsion layer.

When the silver halide emulsion layer sensitive to the same color is constituted of two or more different layers with different sensitivities, it is preferred to apply the emulsion in the silver halide emulsion with the highest sensitivity.

The light-sensitive silver halide photographic material made by use of the silver halide emulsion according to this invention can be developed after exposure according to a known method conventionally used.

A monochromatic developer is an alkali solution containing a developing agent such as hydroxybenzenes, aminophenols, aminobenzenes, etc., containing optionally other compounds such as alkali metal salts of sulfites, carbonates, bisulfites, bromides and iodides. When said light-sensitive silver halide color photographic material is used for color photography, it can be subjected to color developing according to the color developing method conventionally used. According to the reversal process, development is first conducted with a monochromatic nega developer, followed by application of white light exposure or treatment with a bath containing a fog agent, and further color development is effected with an alkali developer containing a color developing agent. The treatment method is not particularly limited, but all treatment methods may be applicable. For example, as typical examples, it is possible to apply a system in which bleach-fixing treatment is conducted after color developing, followed by, if desired, washing with water and stabilization treatment, or a system in which bleaching and fixing are separately conducted, followed by, if desired, washing with water and stabilization treatment.

This invention is described in further detail by referring to the following Examples, by which, however, this invention is not limited.

EXAMPLE 1

According to the double jet method, there were prepared a poly-dispersed (dispersion degree $S/\bar{r}=0.34$) twin crystal emulsion (referred to as Emulsion A) of silver iodobromide (containing 7 mole % of silver iodide) with a mean grain size of 0.65μ, a mono-dispersed ($S/\bar{r}=0.10$) emulsion of octahedral crystals (referred to as Emulsion B), a mono-dispersed ($S/\bar{r}=0.10$) emulsion of cubic crystals (referred to as Emulsion C), and further three kinds of mono-dispersed ($S/\bar{r}=0.10$) emulsions of tetradecahedral crystals with different ratios of (100) faces to (111) faces (referred to as Emulsions D, E and F, respectively), see Table 1.

To each of the above emulsions were added sodium thiosulfate, auric acid chloride, ammonium thiocyanate and the sensitizing dyes shown below, and each of the resultant mixtures was treated with chemical sensitization and spectral sensitization under the respective optimum conditions.

Each emulsion as obtained above was mixed with the stabilizer shown below, and immediately thereafter to a part of the sample, or after being maintained at 40° C. for 6 hours to the residual sample, the color coupler dispersion, a film hardener and a coating agent conventionally used. Each sample was then coated on a triacetate film base support and dried.

Sensitizing dye

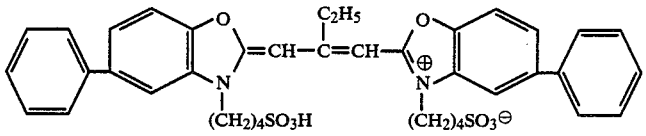

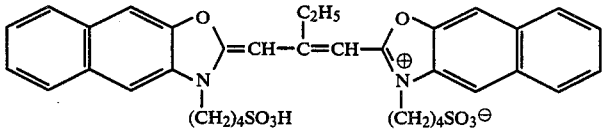

Stabilizer (a) 4-hydroxy-6-methyl-1,3,3a-7-tetrazaindene
(b) 1-phenyl-5-mercapto-tetrazole Color coupler 1-(2,4,6-trichlorophenyl)-3-[3-(2,4-di-t-amylphenoxyacetamido)benzamido]-5-pyrazolone Sensitometry of each of these samples was performed according to the following method.

As a light source for exposure, a tungsten bulb (color temperature 5,400° K.) was used and exposure was effected through a filter and an optical wedge for 1/50 sec. Then, with the use of a color developer having the composition shown below, color developing was carried out at 38° C. for 2 minutes and 45 seconds.

Composition of color developer

| | |
|---|---|
| 4-Amino-3-methyl-N—ethyl-N—(β-hydroxyethyl)-aniline sulfate | 4.8 g |
| Anhydrous sodium sulfite | 0.14 g |
| Hydroxyamine.½ sulfate | 1.98 g |
| Sulfuric acid | 0.74 g |
| Anhydrous potassium carbonate | 28.85 g |
| Anhydrous potassium hydrogen carbonate | 3.46 g |

-continued

| | |
|---|---|
| Anhydrous potassium sulfite | 5.10 g |
| Potassium bromide | 1.16 g |
| Sodium chloride | 0.14 g |
| Nitrilotriacetic acid.3Na(monohydrate) | 1.20 g |
| Potassium hydroxide | 1.48 g |
| Made up to 1 liter with addition of water. | |

The results of sensitometry are shown in Table 1. The sensitivities are represented relatively to the value of the Emulsion A as 100.

TABLE 1

| Sample | Peak ratio of X-ray diffraction (200)/(222) | Coating immediately after ripening | | Coating 6 hrs. after ripening | |
|---|---|---|---|---|---|
| | | Fog | Sensitivity | Fog | Sensitivity |
| Emulsion | | | | | |
| A | — | 0.01 | 100 | 0.02 | 90 |
| B | 100/2960 | 0.005 | 64 | 0.01 | 32 |
| C | 100/0.046 | 0.03 | 135 | 0.05 | 130 |
| D | 100/0.208 | 0.02 | 137 | 0.03 | 136 |
| E | 100/4.24 | 0.01 | 140 | 0.01 | 139 |
| F | 100/19.56 | 0.01 | 92 | 0.02 | 63 |

From the results shown in the above Table 1, it has been made clear that the silver halide emulsions D and E are low in fog and exhibit high sensitivities, both immediately after ripening as a matter of course, and even when coated after 6 hours, namely showing little change in the emulsion with lapse of time.

Next, stabilities to heat of the above samples coated immediately after ripening were examined to obtain the results as shown in Table 2.

TABLE 2

| Sample | Left to stand at room temp., 1 day (standard) | | Left to stand at 55° C., 5 days | |
|---|---|---|---|---|
| | Fog | Sensitivity | Fog | Sensitivity |
| Emulsion | | | | |
| A | 0.01 | 100 | 0.02 | 105 |
| B | 0.005 | 64 | 0.01 | 80 |
| C | 0.03 | 135 | 0.08 | 95 |
| D | 0.02 | 137 | 0.04 | 136 |
| E | 0.01 | 140 | 0.02 | 142 |
| F | 0.01 | 92 | 0.02 | 103 |

From the above results, it can be seen that the emulsion samples D and E are relatively stable in both sensitivity and fog when stored under a high temperature.

EXAMPLE 2

According to the same procedure in Example 1, there were prepared five kinds of core-shell type mono-dispersed silver iodobromide emulsions (cores are silver iodobromide, $S/\bar{r}=0.12$, shells are silver bromide, thickness of shell=0.04μ) of tetradecahedral crystals with a mean grain size of 0.46μ with different silver iodide contents or different X-ray diffraction line peak ratios (K) as indicated in Table 3 set forth below. These emulsions are referred to as Emulsion G, H, I, J and K, respectively. Separately, there were also prepared mono-dispersed dispersions of tetradecahedral crystals having no shell, in which iodine is distributed evenly throughout the whole silver halide grains, and they are referred to as Emulsion L, M.

Each of the above emulsions was provided with chemical sensitization and spectral sensitization by addition of sodium thiosulfate, auric acid chloride, ammonium thiocyanate and the sensitizing dye shown below so that the tone gradation of each emulsion may be substantially equal.

To each of the emulsions obtained above were added the same kind of stabilizer as in Example 1 and the following color coupler dispersion and a film harder and a coating aid conventionally used, and each sample was coated and dried on a triacetate film base support.

Sensitizing dye

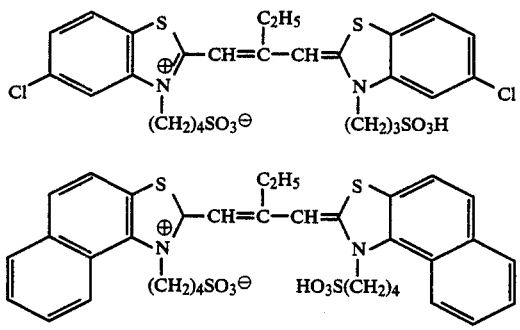

Coupler

1-Hydroxy-2-[δ-(2,4-di-t-amylphenoxy)-n-butyl]naphthoamide

Each of the above samples was treated similarly as in Example 1 and then subjected to sensitometry. The results are shown in Table 3.

TABLE 3

| Sample | Emultion type | Silver iodide* content (mole %) | X-rat-diffraction peak ratio (200)/(222) | Left to stand at room temp., 1 day Fog | Sensitivity | Left to stand at 55° C., 3 days Fog | Sensitivity |
|---|---|---|---|---|---|---|---|
| Emulsion | | | | | | | |
| G | Core-shell | 6 | 100/2.45 | 0.02 | 125 | 0.03 | 127 |
| H | Core-shell | 8 | 100/2.45 | 0.02 | 112 | 0.04 | 115 |
| I | Core-shell | 13 | 100/2.43 | 0.03 | 109 | 0.43 | 98 |
| J | Core-shell | 6 | 100/0.050 | 0.04 | 123 | 0.16 | 104 |
| K | Core-shell | 6 | 100/20.13 | 0.01 | 88 | 0.02 | 101 |
| L | No shell | 6 | 100/2.44 | 0.03 | 100 | 0.47 | 85 |
| M | No shell | 8 | 100/2.41 | 0.04 | 97 | 0.61 | 67 |

*Silver iodide mole % based on the whole grains.

As can be seen also from the above Table 3, in the emulsions G and H, which are mono-dispersed emulsion samples comprising core-shell type tetradecahedral crystals containing the iodine contents according to this invention, higher sensitivity can be obtained, as compared with other Control samples, and in the heat resistance test, not only the sensitivity is stable, but also the fog is stable without increase.

EXAMPLE 3

The emulsion sample E prepared in Example 1 was subjected to gold-sulfur sensitization with chemical sensitizers of sodium thiosulfate and auric acid chloride in the presence or absence of ammonium thiocyanate. To each emulsion were further added the same kind of stabilizer as in Example 1, the following coupler dispersion and a film hardener and a coating aid conventionally used, and each sample was coated on a triacetate film base support, followed by drying. These samples were subjected to sensitometry similarly as in Example 1.

Color coupler

α-Pivaloyl-α-(1-benzyl-2-phenyl-3,5-dioxyimidazollidine-4-yl)-2'-chloro-5'-[α-(dodecyloxycarbonyl)ethoxycarbonyl]acetoanilide The results are shown in the following Table 4.

TABLE 4

| Sample | Solvent* | Sensitizer A** | Sensitizer B*** | Temp. | Characteristics Fog | Characteristics Sensitivity |
|---|---|---|---|---|---|---|
| Control | 0 | 2.83 | 4.25 | 60° C. | 0.02 | 100 |
| Invention | 2.83 | 2.83 | 4.25 | 60° C. | 0.04 | 224 |

*1% aq. ammonium thiocyanate solution (ml/mol AgX)
**0.02% aq. auric acid chloride solution (ml/mol AgX)
***0.025% aq. sodium thiosulfate solution (ml/mol AgX)

As apparently seen also from the above Table, the sample, in which the silver halide grains according to this invention are chemically sensitized in the presence of ammonium thiocyanate as a solvent for silver halide, are markedly improved in their sensitizing effect.

EXAMPLE 4

According to the same procedure as in Example 1, mono-dispersed silver iodobromide emulsions comprising three kinds of core-shell type tetradecahedral crystals with mean grain sizes of 0.70, 0.42 and 0.20μ (shell thickness: 1/10 of grain size) were prepared (Emulsion A, B and C). The respective emulsions contained silver iodide in amounts of 4 moles, 6 moles and 8 moles, with the R-ray diffraction peak ratios (K) of 100/4.24, 100/2.10 and 100/1.50, respectively. These emulsions A, B and C are chemically sensitized and spectrally sensitized similarly as in Examples 1, 2, and 3 to provide red-sensitive, green-sensitive and blue-sensitive emulsions.

Then, by use of these emulsions, an ordinary multilayer nega film was prepared and subjected to heat resistance test, whereby it was confirmed as shown in the following Table that each sensitive layer exhibited only small changes in sensitivity and fog, in a manner similar to Examples 1 and 2.

TABLE 5

| | Standard | | Left to stand at 55° C., 3 days | |
|---|---|---|---|---|
| | Fog | Sensitivity | Fog | Sensitivity |
| Red-sensitive layer | 0.01 | 100 | 0.015 | 103 |
| Blue-sensitive layer | 0.01 | 100 | 0.015 | 100 |
| Green-sensitive layer | 0.005 | 100 | 0.010 | 101 |

We claim:

1. A light-sensitive silver halide photographic material having silver halide emulsion layers on a support, wherein at least one layer of said silver halide emulsion layers contains surface latent image-forming mono-dispersed silver halide grains, and 50% or more of the silver halide grains contained in said at least one silver halide emulsion layer are core-shell silver halide grains containing cores comprising a silver halide containing silver iodide and shells comprising primarily silver bromide covering said cores and are the surface latent image-forming mono-dispersed silver halide grains of tetradecahedral regular crystals whose external surfaces have crystal faces (100) and (111), the area ratio of said (100) face and said (111) face represented by:

$$K = \frac{\text{Area of (100) face}}{\text{Area of (111) face}}$$

and satisfying the following formula:

$$\frac{100}{13} \leqq K \leqq \frac{100}{0.2}$$

wherein K is the ratio between the intensities of respective diffraction lines attributable to the (200) face at 30.9° of the diffraction angle which corresponds to the (100) face and the (222) face at 55° of the diffraction angle which corresponds to the (111) face measured in X-ray diffraction analysis as set forth in the following formula $$K = \frac{\text{Diffraction line intensity due to (200) face}}{\text{Diffraction line intensity due to (222) face}}.$$

2. The light-sensitive silver halide photographic material according to claim 1, wherein the mono-dispersed silver halide grains which have uniform shapes of individual silver halide grains, have regular substantially uniformly and evenly arranged grain sizes, and have a grain size distribution as defined by the following formula:

$$S = \sqrt{\frac{\Sigma(\bar{r} - r_i)^2 n_i}{\Sigma n_i}}$$

$$\frac{S}{\bar{r}} \leqq 0.20$$

wherein S is the standard deviation S, $\bar{r}$ is the mean grain size, ri represents the individual grain sizes and their numbers are represented by ni.

3. The light-sensitive silver halide photographic material according to claim 1, wherein said silver halide grains consist essentially of core-shell type silver halide grains.

4. The light-sensitive silver halide photographic material according to claim 1, wherein said silver halide grains comprise silver iodide at a level of 3 to 12 mole %.

5. The light-sensitive silver halide photographic material according to claim 4, wherein said silver halide grains comprise silver iodide at a level of 5 to 10 mole %.

6. The light-sensitive silver halide photographic material according to claim 3, wherein said core-shell type silver halide grains comprise shells having a thickness of 0.001 to 0.1μ.

7. The light-sensitive silver halide photographic material according to claim 2, wherein said silver halide grains consist essentially of core-shell type silver halide grains which consist essentially of cores comprising a silver halide containing silver iodide and shells comprising primarily silver bromide covering said cores.

8. The light-sensitive silver halide photographic material according to claim 7, wherein said core-shell type silver halide grains comprise shells having a thickness of 0.001 to 0.1μ.

9. The light-sensitive silver halide photographic material according to claim 8, wherein said silver halide grains comprise silver iodide at a level of 5 to 10 mole %.

10. The light-sensitive silver halide photographic material according to claim 7, wherein said silver halide grains comprise silver iodide at a level of 5 to 10 mole %.

* * * * *